US005593237A

United States Patent [19]

Nozaki et al.

[11] Patent Number: 5,593,237

[45] Date of Patent: Jan. 14, 1997

[54] PRINTING APPARATUS AND INK RIBBON CASSETTE THEREFOR

[75] Inventors: Mineo Nozaki, Kawasaki; Osamu Asakura, Tokyo; Yoshio Uchikata, Kawasaki; Masasumi Nagashima, Yokosuka, all of Japan

[73] Assignee: Canon Kabushiki Kaisha, Tokyo, Japan

[21] Appl. No.: 447,424

[22] Filed: May 23, 1995

Related U.S. Application Data

[63] Continuation of Ser. No. 8,829, Jan. 25, 1993, abandoned, which is a continuation of Ser. No. 384,068, Jul. 24, 1989, abandoned, which is a continuation of Ser. No. 228,766, Aug. 4, 1988, abandoned, which is a continuation of Ser. No. 935,082, Nov. 24, 1986, abandoned, which is a continuation of Ser. No. 667,363, Nov. 1, 1984, abandoned.

[30] Foreign Application Priority Data

| | | | |
|---|---|---|---|
| Nov. 7, 1983 | [JP] | Japan | 58-207576 |
| Nov. 7, 1983 | [JP] | Japan | 58-207577 |
| Nov. 7, 1983 | [JP] | Japan | 58-207578 |
| Nov. 7, 1983 | [JP] | Japan | 58-207579 |

[51] Int. Cl.[6] ..... B41J 32/00; B41J 35/28

[52] U.S. Cl. ..... 400/208; 400/234; 400/249

[58] Field of Search ..... 400/194–196.1, 400/207, 208, 208.1, 234, 249, 708

[56] References Cited

U.S. PATENT DOCUMENTS

| | | | |
|---|---|---|---|
| 3,974,906 | 8/1976 | Lee et al. | 400/208 X |
| 4,010,839 | 3/1977 | Guerrini et al. | 400/234 X |
| 4,074,800 | 2/1978 | Steinke | 400/196 X |
| 4,083,444 | 4/1978 | Salto | 400/208 |
| 4,115,013 | 9/1978 | Hedstrom | 400/249 |
| 4,134,693 | 1/1979 | Crickmore et al. | 400/208 |
| 4,146,338 | 3/1979 | Hedstrom | 400/249 |
| 4,210,403 | 7/1980 | Mazouet et al. | 400/196.1 |
| 4,406,553 | 9/1983 | Nally et al. | 400/208 |
| 4,407,593 | 10/1983 | Haftmann | 400/208 |
| 4,408,914 | 10/1983 | Ciesiel et al. | 400/208 |
| 4,443,827 | 4/1984 | Hoover et al. | 360/132 |
| 4,451,166 | 5/1984 | Frechette et al. | 400/208 |
| 4,462,707 | 7/1984 | Falconieri | 400/208 |
| 4,468,139 | 8/1984 | Hattori | 400/196 X |
| 4,479,730 | 10/1984 | Yoshioka et al. | 400/249 X |
| 4,498,792 | 2/1985 | Falconieri | 400/208 X |
| 4,505,604 | 3/1985 | Takemoto | 400/208 |

FOREIGN PATENT DOCUMENTS

| | | | |
|---|---|---|---|
| 1119549 | 3/1982 | Canada . | |
| 0014763 | 9/1980 | European Pat. Off. . | |
| 0034026 | 8/1981 | European Pat. Off. | 400/196.1 |
| 0126203 | 11/1984 | European Pat. Off. . | |
| 2902719 | 8/1979 | Germany . | |
| 3015726 | 10/1981 | Germany . | |
| 3244665 | 6/1984 | Germany . | |
| 55-158996 | 12/1980 | Japan . | |
| 56-21884 | 2/1981 | Japan . | |
| 56-123888 | 9/1981 | Japan . | |
| 47685 | 3/1982 | Japan | 400/249 |
| 57-128584 | 8/1982 | Japan . | |
| 193386 | 11/1982 | Japan | 400/249 |
| 1409452 | 10/1975 | United Kingdom . | |
| 1554445 | 10/1979 | United Kingdom . | |

OTHER PUBLICATIONS

R. V. Firth, et al., "Web–Retention Spring", IBM Technical Disclosure Bulletin, vol. 22, No. 6, p. 2386 (Nov. 1979).

*Primary Examiner*—Stephen R. Funk
*Attorney, Agent, or Firm*—Fitzpatrick, Cella, Harper & Scinto

[57] ABSTRACT

An ink ribbon cassette has a case housing an ink ribbon inside. Holes for receiving positioning members are formed at the two ends of a front portion of the case, and an engaging member is formed at the center of a rear portion of the case. One of the positioning members also serves as an ink ribbon end detector. A printing apparatus for printing using such an ink ribbon cassette has a carriage, projections and a spring. Thus, the slackening of the ink ribbon will not occur in the printing mode.

12 Claims, 9 Drawing Sheets

Fig. 1
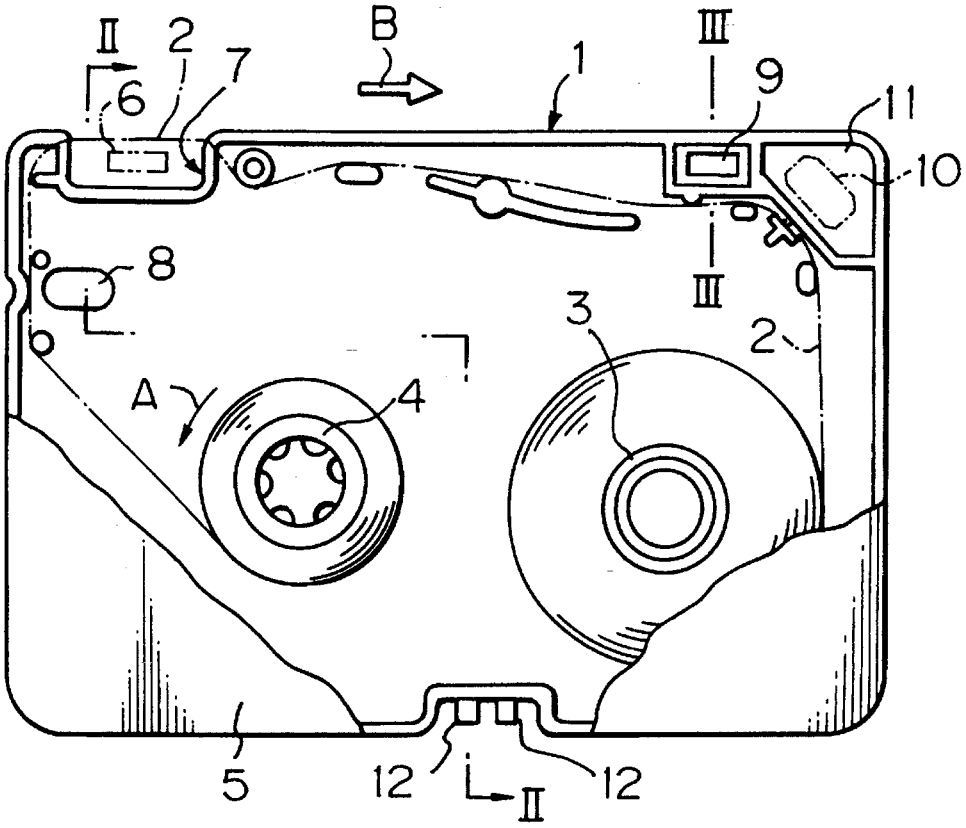
Fig. 2
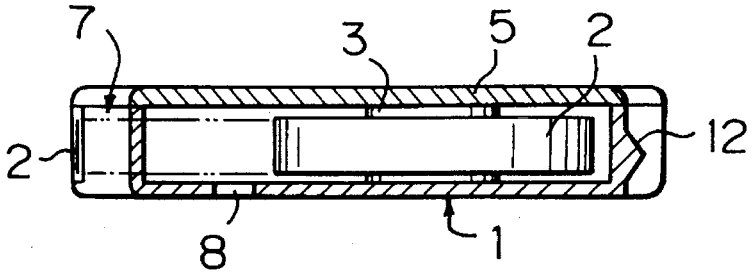
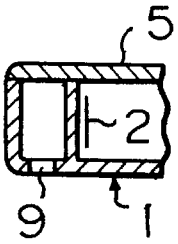
Fig. 3

PRINTING APPARATUS AND INK RIBBON CASSETTE THEREFOR

This application is a continuation of application Ser. No. 08/008,829, filed Jan. 25, 1993, which is a continuation of application Ser. No. 07/384,068, filed Jul. 24, 1989, which is a continuation of application Ser. No. 07/228,766, filed Aug. 4, 1988, which is a continuation of application Ser. No. 06/935,082, filed Nov. 24, 1986, and which is a continuation of application Ser. No. 06/667,363, filed Nov. 1, 1984, now all abandoned.

BACKGROUND OF THE INVENTION

1. Field of the Invention

The present invention relates to an ink ribbon cassette housing an ink ribbon therein and a printing apparatus using such an ink ribbon cassette.

2. Description of the Prior Art

An ink ribbon cassette housing an ink ribbon therein is usually used in a printing apparatus which serially prints (records) characters or graphic patterns. Such an ink ribbon cassette is typically placed on a carriage to be moved thereby. In this case, the ink ribbon cassette must be held at a correct position. At the same time, the ink ribbon cassette must be light in weight, and space inside the cassette must be utilized effectively.

In an ink ribbon cassette of this type, a printing head inserting portion is generally arranged at the center of the front surface of the cassette.

Furthermore, in an ink ribbon cassette of this type, an almost exhausted state of the ink ribbon is detected to control a printing operation. More specifically, the printing operation is controlled using a ribbon end detector arranged on a carriage. The ribbon end detector includes means for photoelectrically detecting a difference in reflectivity at the ribbon end. The ribbon end detector is inserted at a position adjacent to the ribbon feed path inside the cassette. When the ribbon end is detected or after a predetermined period of time has elapsed after such detection, the printing operation is stopped to prevent poor printing.

In a conventional ribbon cassette, a printing head inserting portion is arranged at the center of the front surface of the cassette. A ribbon end detector inserting portion is arranged at a suitable position on a ribbon travel path from a supply reel to the printing head inserting position. Therefore, a length of a ribbon portion from the ribbon end detector to the printing head, i.e., the detection distance is rendered relatively short. Thus, printing cannot be continued for a predetermined period of time after detection of the ribbon end (e.g., to an end of a line, or an end of a current image portion, or the like). Printing quality without an unnatural density difference accordingly cannot be obtained.

The ribbon inside the cassette is repeatedly driven or stopped in accordance with a printing signal from a printing apparatus. Since the driving or stopping operation of the ribbon is performed abruptly, slackening or loosening of the ribbon tends to be caused. This is especially the case when the ribbon is stopped, and the supply reel continues to rotate by inertia. Even when the ribbon cassette is not used, when the ribbon cassette is moved, the supply or take-up reel is moved and similarly causes slackening of the ink ribbon. When the ribbon cassette is mounted on the printing apparatus, and such slackening of the ribbon takes place at a printing position, it is especially likely that the ribbon will be accidentally caught by the printing head. In addition, since the ribbon is not correctly located, printing quality may be degraded.

In the ink ribbon cassette, many parts are assembled within the cassette and, for this reason, the assembly is cumbersome. If an additional function is added to the cassette, the assembly becomes even more complex.

As described above, the ribbon inside the cassette is repeatedly driven or stopped in accordance with a printing signal from the printing apparatus. Since the driving and stopping operation of the ribbon is performed abruptly, slackening or loosening of the ribbon tends to be caused. This is especially the case when the ribbon is stopped, and the supply reel continues to rotate by its inertia. Even when the ribbon cassette is not used, when the ribbon cassette is moved, the supply or take-up reel is moved and similarly causes slackening of the ink ribbon. Meanwhile, in the ribbon cassette, ribbon end detection is performed ahead of the printing position along the ribbon travel path. This detection is performed optically by detecting an amount of reflected light from the travelling ribbon which is irradiated with light. When a slackening of the ribbon is caused at the ribbon end detection position, an erroneous detection is very likely to be caused.

SUMMARY OF THE INVENTION

It is an object of the present invention to provide an ink ribbon cassette which is simple in construction, compact in size, and light in weight, and which can be securely held at a predetermined position.

It is another object of the present invention to keep a printing position and a detection position of ribbon information as far as possible from each other within a limited space inside a ribbon cassette.

It is still another object of the present invention to prevent slackening of an ink ribbon.

It is still another object of the present invention to simplify the assembly of a ribbon cassette having a function to apply a back tension to an ink ribbon.

It is still another object of the present invention to correctly detect information of an ink ribbon.

It is still another object of the present invention to simplify the construction of an ink ribbon cassette by using a detector which detects information of an ink ribbon and which also serves as positioning means.

It is still another object of the present invention to provide a printing apparatus which has a simple construction and which can securely hold an ink ribbon cassette.

It is still another object of the present invention to provide a printing apparatus wherein when an ink ribbon cassette is mounted, an ink ribbon is not caught by a head or the like.

The above and other objects and features of the present invention will become apparent from the following description taken in conjunction with the accompanying drawings.

BRIEF DESCRIPTION OF THE DRAWINGS

FIG. 1 is a partially cutaway plan view showing an ink ribbon cassette according to a first embodiment of the present invention;

FIG. 2 is a sectional view along the line II—II in FIG. 1;

FIG. 3 is a partial sectional view along the line III—III in FIG. 1;

DETAILED DESCRIPTION OF THE PREFERRED EMBODIMENTS

Figure 4:
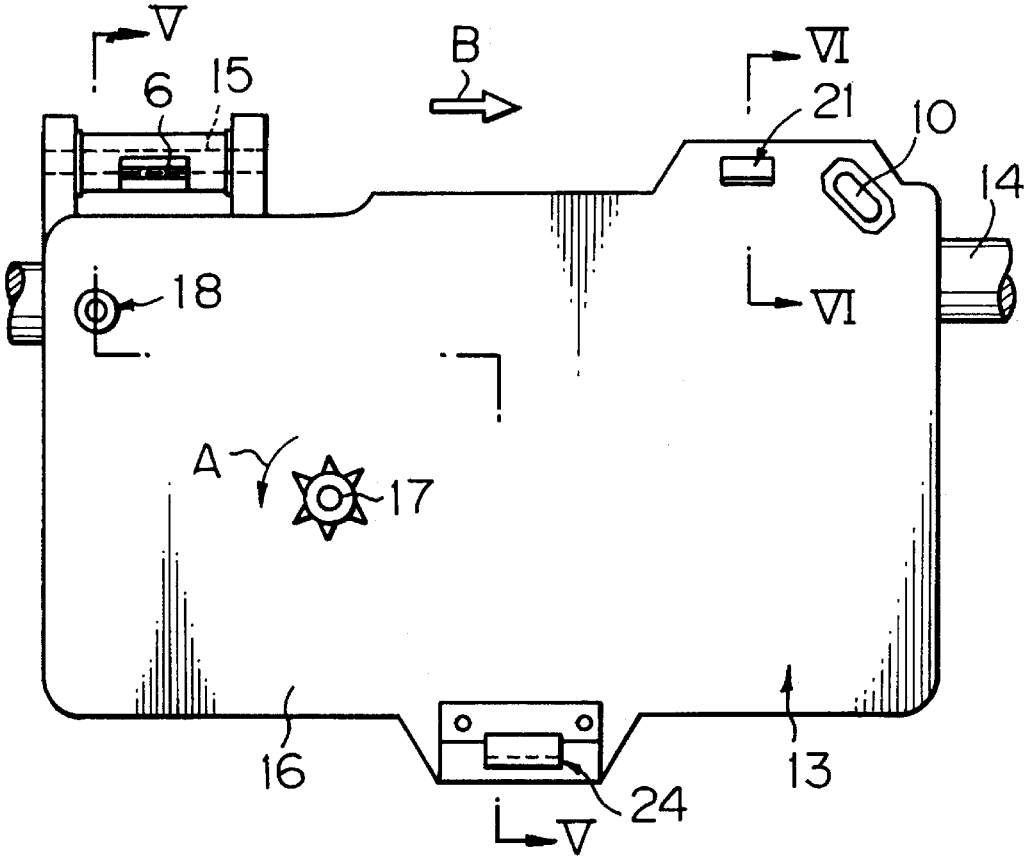
FIG. 4 is a plan view showing a carriage according to the first embodiment.

FIGS. 1 to 3 show an ink ribbon cassette according to a first embodiment of the present invention for a printing apparatus according to the present invention.

Referring to FIGS. 1 to 3, a supply reel 3 and a take-up reel 4 of an ink ribbon 2 are arranged inside a substantially rectangular cassette case 1. When the take-up reel is driven in the direction indicated by arrow A, the ribbon is fed. A case cover 5 is detachably fitted on an upper surface of the cassette case 1. In a printing mode, the ribbon cassette is moved together with a carriage in the direction indicated by arrow B (to the right).

A recess 7 for receiving a printing head 6 is formed at the left side of the front surface of the cassette case 1. The ink ribbon 2 is passed through an opening end of the recess 7. In the printing mode, the printing head 6 is moved to a position at which it can urge the ink ribbon 2 from its rear surface against a paper sheet (not shown). As shown in FIGS. 1 to 3, the ink ribbon 2 is fed from the supply reel 3 to the take-up reel 4 through a predetermined path by a plurality of guide members inside the cassette case 1. The ink ribbon 2 thus fed is fed so as to be exposed to the outside of the case 1 at the portion of the recess 7.

An opening 8 as an elongated fitting portion is formed in the vicinity of the recess 7 of the cassette case 1, i.e., in the vicinity of the printing head 6. A guide pin of the carriage to be described later is fitted inside the opening 8. An opening 9 for receiving a carriage positioning projection to be described later is formed at the front right side of the cassette case 1, i.e., to the far side of the opening 8.

The ink ribbon cassette illustrated in FIGS. 1 to 3 is of a type which allows the use of a ribbon end detector 10. An opening 11 for receiving the ribbon end detector 10 fixed on the carriage is formed at the front right corner of the cassette 1.

The ribbon end detector 10 serves to detect a boundary between an ink portion and a terminal end portion of the ribbon 2. The detector 10 comprises a photoelectric detector which utilizes the difference in reflectivity at different portions of the ribbon.

In this manner, the recess 7 for receiving the printing head 6 and the opening 11 for receiving the ribbon end detector 10 are arranged at the left and right corners of the cassette case 1. Therefore, the length of the ribbon portion between these positions, i.e., the detection distance, can be increased. A convenient printing operation stop position, such as the end of a print line, thus can be easily obtained. For example, printing can be performed to a suitable boundary position such as an end of a line or an end of an image portion, and printing without density irregularities can be performed.

Projections 12 as engaging members which engage with a press spring to be described later are formed at substantially the center of the rear surface of the cassette case 1. As shown in FIG. 1, two projections 12 are formed, each having upper and lower surfaces inclined at predetermined angles. The cassette case 1 receives the biasing force of the press spring action against a carriage 13 through the inclined surfaces of the projections 12.

Figure 5:
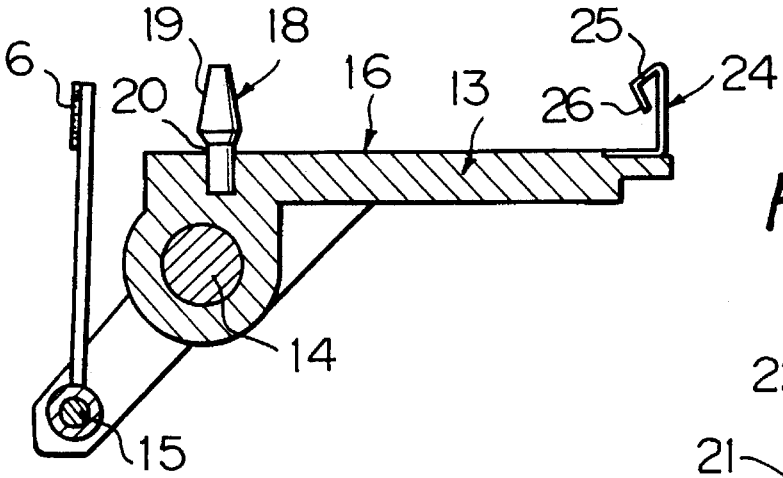
FIG. 5 is a sectional view along the line V—V in FIG. 4.
Figure 6:
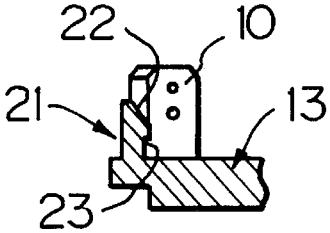
FIG. 6 is a partial sectional view along the line VI—VI in FIG. 4.

FIGS. 4 to 6 show a cassette support device according to a first embodiment of a printing apparatus according to the present invention.

Referring to FIGS. 4 to 6, the carriage 13 is driven in the right-to-left direction along a guide shaft 14. When the carriage 13 is moved in a printing direction B, the printing head 6 is driven to print on a paper sheet (not shown).

The printing head 6 is axially supported to pivot through a shaft 15 at the front left portion of the carriage 13, as shown in FIGS. 4 to 6. The printing head 6 is driven between the illustrated head-up position and the paper urging position at which it is urged against the paper through the ink ribbon.

The cassette as shown in FIGS. 1 to 3 is placed on an upper surface 16 (FIG. 4) of the carriage 13. A ribbon hub 17 for receiving and driving the take-up reel 4 is arranged at a position of the cassette which corresponds to the take-up reel 4.

A guide pin 18 as a case positioning member to be inserted into the opening 8 of the cassette case 1 is arranged on a position of the carriage 13 which is near the printing head 6. As illustrated in FIGS. 4 to 6, the guide pin 18 has a guiding tapered portion 19 and a step portion 20 for positioning in a front-to-back direction. The distal end of the guide pin 18 has a height substantially the same as that of the distal end of the printing head 6. The position of the guide pin 18 is selected such that when the step portion 20 of the guide pin 18 is abutted against the rear side end face of the opening 8 of the cassette case 1, the ink ribbon cassette is supported at a predetermined position.

A positioning projection 21 to be inserted into the opening 9 of the cassette case 1 when the cassette is mounted is formed at the right side portion of the cassette 13. The projection 21 has a guiding tapered portion 22 and a step portion 23 for positioning in the front-to-back direction. The dimension of the opening 9 in the right-to-left direction corresponding to that of the projection 21 is selected to allow loose fitting of the projection 21 in the opening 9, i.e., positioning of the cassette along the right-to-left direction.

The photoelectric ribbon end detector 10 is fixed at the position of the front right corner of the carriage 13 which corresponds to the opening 11.

A spring 24 as a biasing means is mounted at substantially the center of the rear side of the carriage 13. The spring 24 engages with the projecttions 12 of the cassette case 1. The spring 24 has a guiding upper inclined surface 25 and a lower inclined surface 26 for vertical positioning. The shape and position of the spring 24 are selected such that when the cassette is mounted, the spring 24 is deflected backward by a predetermined amount to urge the cassette toward the front by the predetermined biasing force so as to urge the edge of the opening 8 against the guide pin 18 and the edge of the opening 9 against the positioning projection 21.

Figure 7:
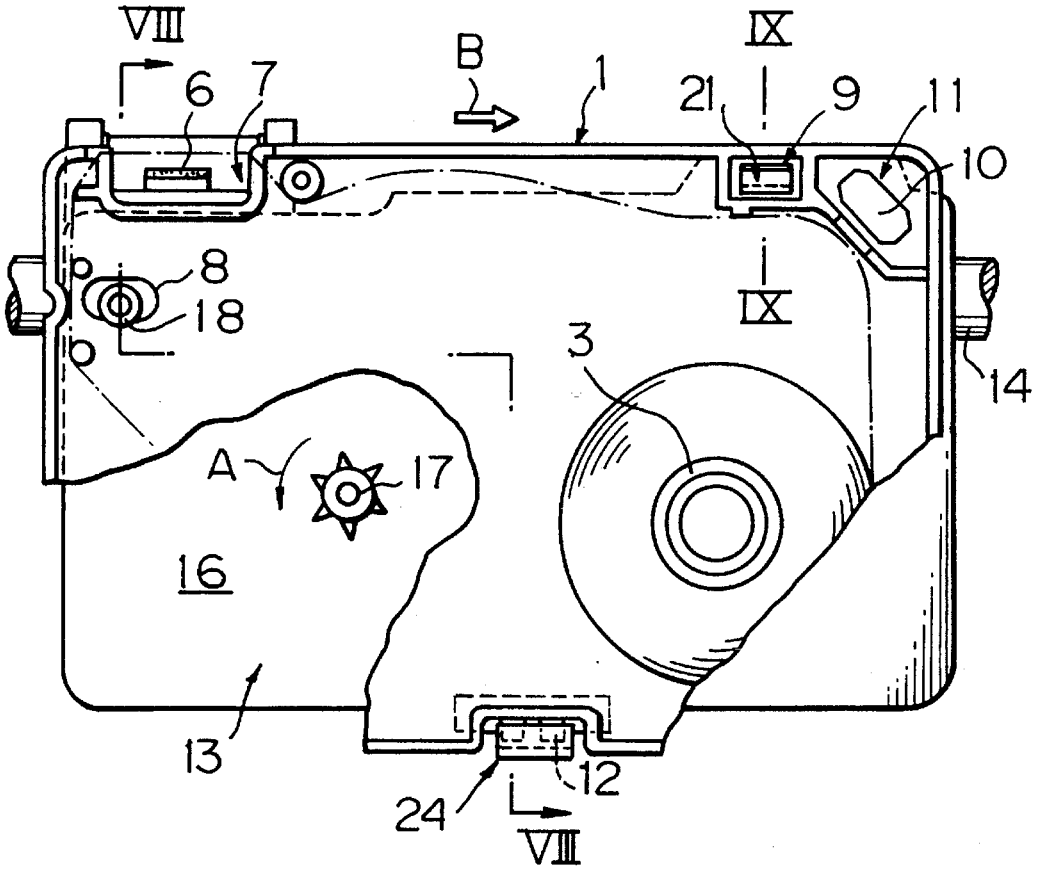
FIG. 7 is a partially cutaway plan view of the ribbon cassette shown in FIG. 1 which is supported on the carriage shown in FIG. 4.
Figure 8:
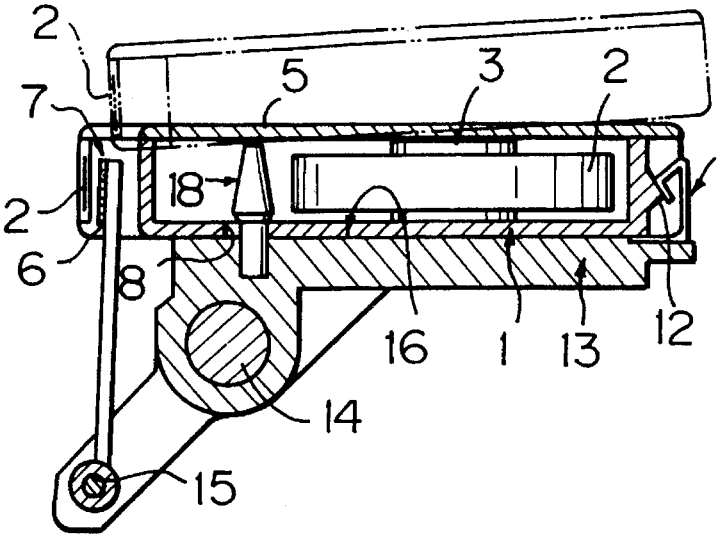
FIG. 8 is a sectional view along the line VIII—VIII shown in FIG. 7.
Figure 9:
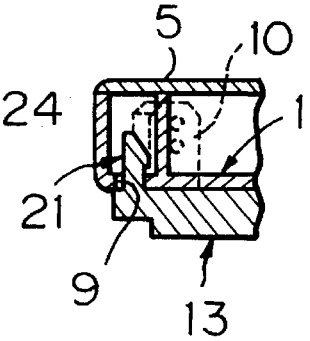
FIG. 9 is a partial sectional view along the line IX—IX in FIG. 7.

FIGS. 7 to 9 show the state wherein the ink ribbon cassette shown in FIGS. 1 to 3 is mounted on the carriage shown in FIGS. 4 to 6. The same reference numerals denote the same parts in these figures.

When the ribbon cassette is mounted, the left side of the cassette case 1 is pushed so that the opening 8 receives the guide pin 18 to a predetermined depth. Then, the right side of the cassette case 1 is pushed so that the opening 9 receives the projection 21 to a predetermined depth, thus positioning the cassette case 1 in the front-to-back direction. Then, while the projections 12 at the rear side of the cassette case 1 are urged against a guide portion 25 of the spring 24, the rear portion of the cassette case 1 is pushed against the biasing force of the spring 24. At the same time, the front portion of the cassette case 1 is also pressed to a mount position with respect to the guide pin 18 and the positioning projection 21.

When the above operation is completed, the ribbon cassette is mounted in the state as shown in FIGS. 7 to 9. The rear edges of the openings 8 and 9 are urged against the guide pin 18 and the step portion of the positioning projection 21 by the biasing force of the spring 24. At the same time, the ribbon cassette is pressed downward and to the front, i.e., obliquely, by the urging force acting between the lower inclined surface 26 of the spring 24 and the upper inclined surfaces of the projections 12. The position of the cassette along the right-to-left direction is determined by the positioning projection 21.

In this manner, the ribbon cassette is supported at three points, i.e., the guide pin 18, the positioning projection 21, and the spring 24. Thus, the ribbon cassette is positioned in the right-to-left direction, the front-to-back direction and the vertical direction.

Since the ribbon cassette is supported at three points, i.e., the left and right ends toward the front along the longitudinal direction and substantially at the center of the cassette, it can be securely positioned at a correct position with only a simple construction.

Demounting of the ribbon cassette can be performed in the same manner but in a reverse order to that of mounting of the ribbon cassette.

In the embodiment described above, the height of the guide pin 18 is substantially the same as that of the distal end of the printing head 6. Therefore, when the opening 8 and the guide pin 18 are unmatched in position during mounting of the cassette, the bottom surface of the cassette abuts against the guide pin and cannot be moved downward beyond the position indicated by the alternate two short and one long dashed line in FIG. 8. The guide pin 18 arranged near the printing head 6 also prevents contact between the ink ribbon 2 and the printing head 6 during mounting of the cassette. Thus, loosening or slackening of the ribbon due to contact with the printing head can be prevented.

Figure 10:
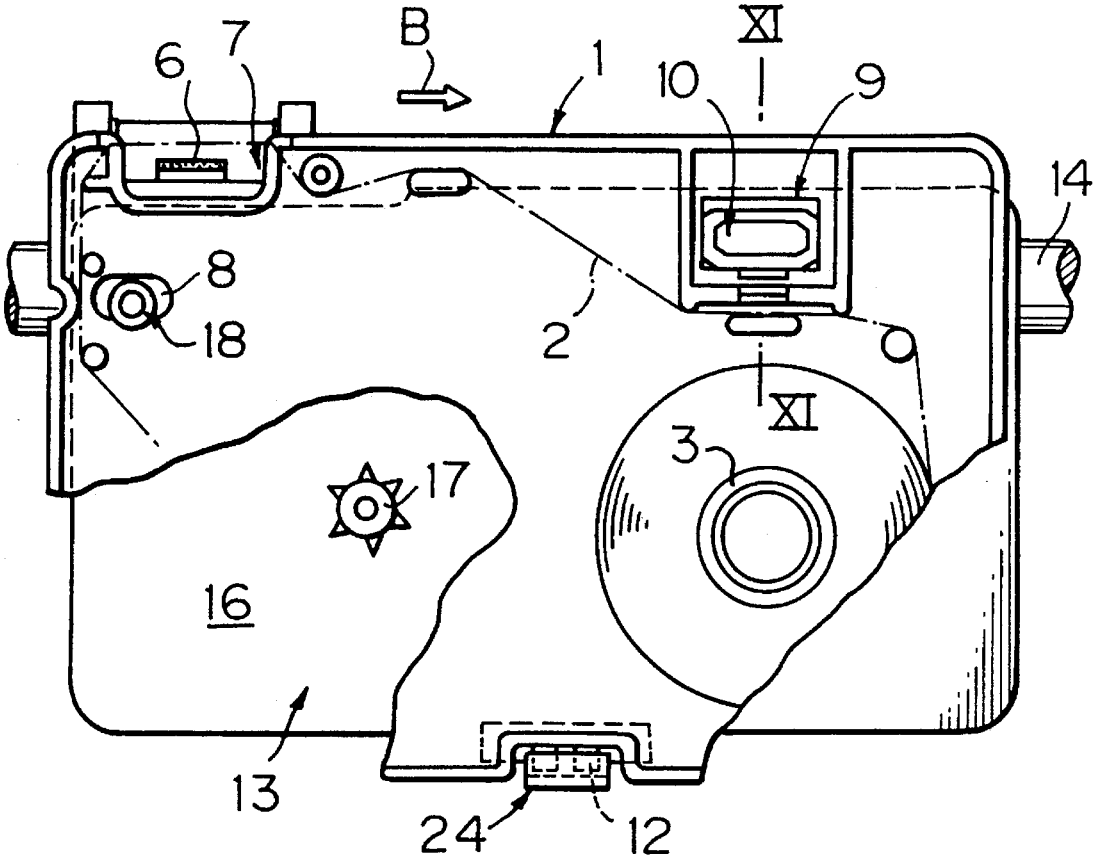
FIG. 10 is a partially cutaway plan view of a cassette support device according to a second embodiment of the present invention, with the cassette support device mounting a cassette.
Figure 11:
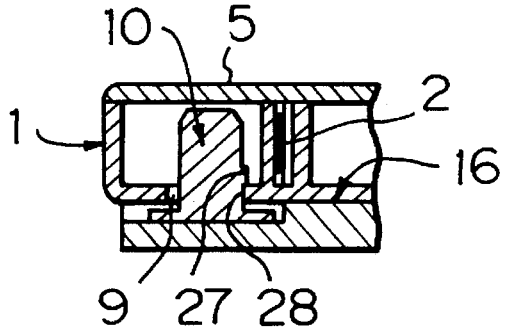
FIG. 11 is a partial sectional view along the line XI—XI in FIG. 10.

FIGS. 10 and 11 show a second embodiment of the present invention.

The second embodiment is substantially the same as the first embodiment except that the ribbon end detector 10 itself is used as a positioning projection, the positioning projection 21 and the opening 11 of the first embodiment are omitted, and the ribbon end detector 10 is arranged in a position advantageous for positioning of the cassette in the front-to-back direction. The same reference numerals as in the first embodiment denote the same parts in the second embodiment, and a detailed description thereof will be omitted.

A bulged portion 27 is formed on the rear surface of the ribbon end detector 10 in this embodiment. A positioning surface 28 for positioning in the front-to-back direction and in the vertical direction is formed below the bulged portion 27. The positioning surface 28 corresponds to the step 23 of the projection 21 in the first embodiment. For the same reason as in the first embodiment, the dimension of the opening 9 along the right-to-left direction is set to be slightly larger by a gap than that of the ribbon end detector 10 and to allow positioning of the cassette in the right-to-left direction.

According to the second embodiment, the same effect as that obtainable in the first embodiment can be obtained. In addition, the positioning projection 21 can be omitted to simplify the structure.

In the first and second embodiments described above, the height of the guide pin 18 is set to be substantially the same as that of the distal end of the printing head 6. However, the height of the guide pin 18 can be properly selected with consideration for the sizes and structures of the associated parts so that the ribbon 2 does not come into contact with the printing head 6.

The above embodiments are described with reference to the case wherein the ribbon end detector 10 is incorporated within the cassette. However, the present invention can be similarly applied to ribbon cassettes with or without such ribbon end detectors.

Figure 12:
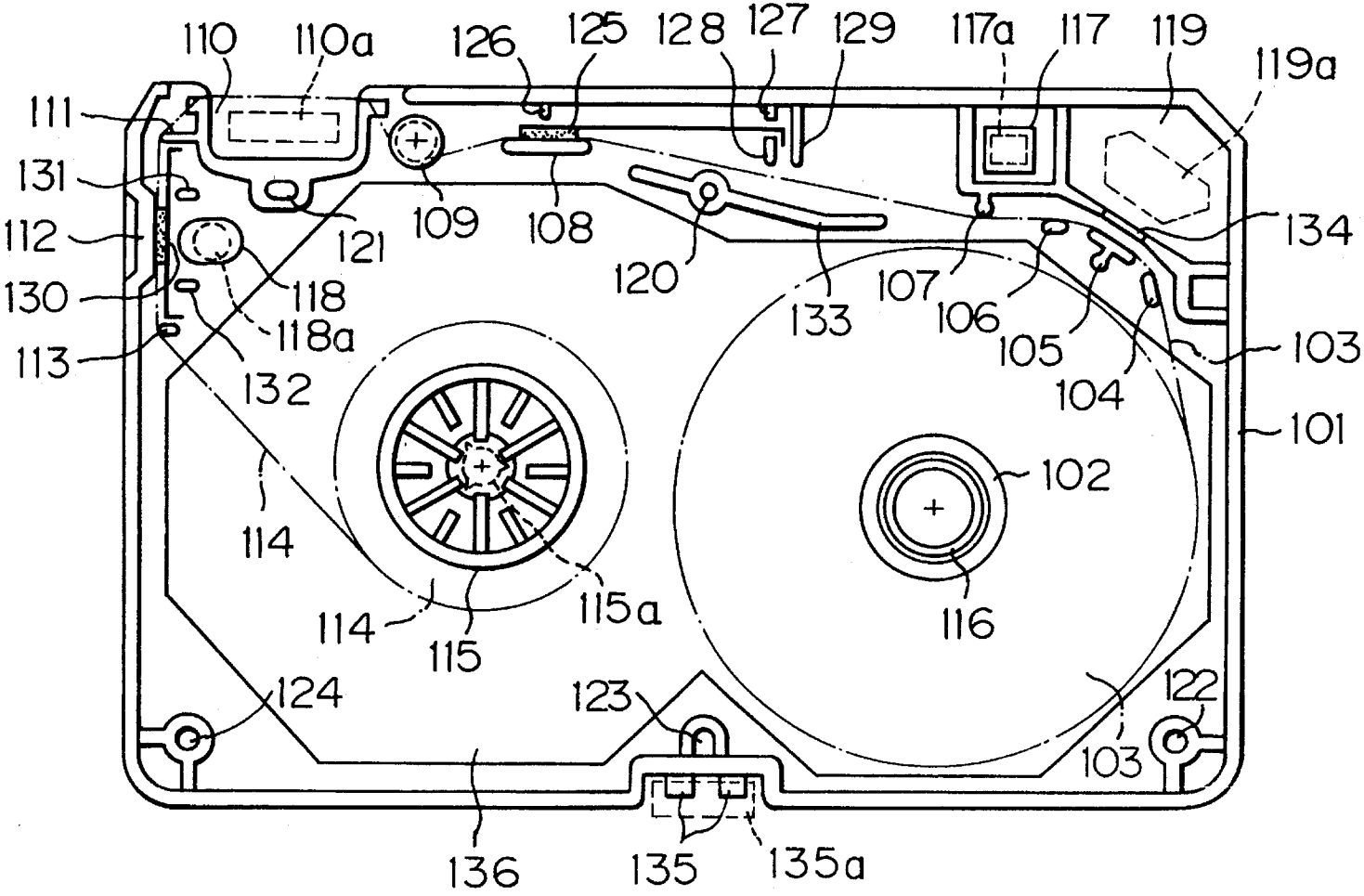
FIG. 12 is a plan view of a ribbon cassette according to a third embodiment of the present invention, with an upper cover of the cassette being removed.
Figure 13:
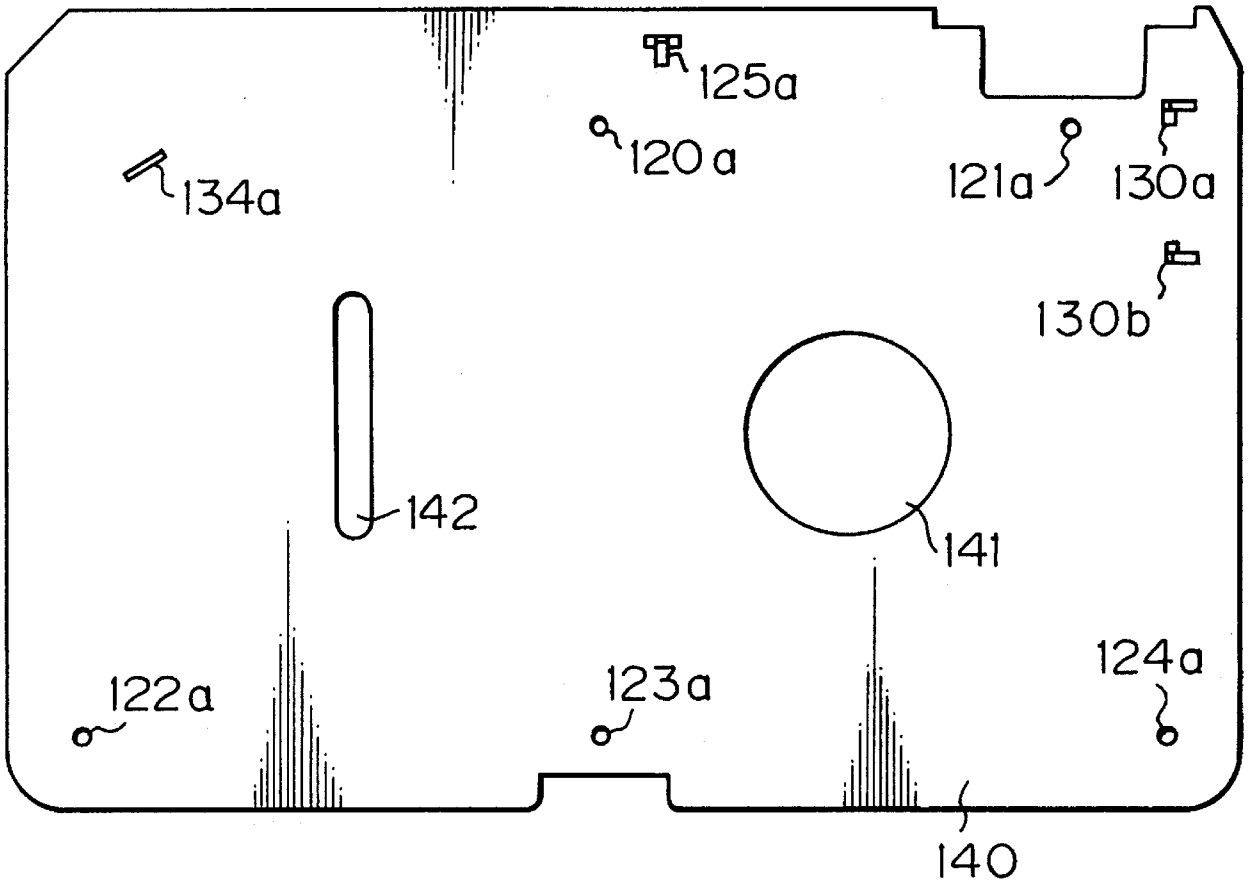
FIG. 13 is a bottom view of the upper cover.

FIG. 12 is a plan view showing a ribbon cassette according to a third embodiment of the present invention, wherein the upper cover of a cassette case is removed. FIG. 13 is a bottom view of the upper cover. An unused ribbon 103 wound around a core 102 inside a cassette case 101 is fed to a printing position 110 (outside the cassette case) through guide members 104, 105, 106, 107 and 108 and a guide roller 109. The ribbon 103 is then fed to a travel path through guide members 111, 112 and 113, and a used ribbon 114 is wound around a core 115. A cylindrical member 116 rotatably holds the core 102. Cassette positioning holes 117 and 118 are formed in the bottom surface of the case 101. A ribbon end detector opening 119 is also formed in the bottom surface of the case 101. Engaging small holes 120, 121, 122, 123, and 124 are for engaging with an upper cover. An elastic plate with felt 125 applies a back tension to the ink ribbon. The elastic plate 125 is arranged such that the felt surface faces the unused ribbon 103 travelling on the guide member 108. Members 126, 127, 128 and 129 limit the position of the elastic plate 125. Another elastic plate with felt 130 is also arranged such that its felt surface faces the used ribbon 114 travelling on the guide member 112. Members 131 and 132 limit the position of the elastic plate 130. A partition member 133 guarantees a space for a ribbon feed path. A window 134 is used for detecting a ribbon end. Cassette positioning projections 135 are formed on a rear side surface of the cassette case. An antistatic sheet 136 is placed on the inner bottom surface of the case.

Referring to FIG. 13, an upper cover 140 for covering the cassette case 101 is a flat plate having an outer shape substantially corresponding to an outer shape of the cassette case 101. Engaging small projections 120*a*, 121*a*, 122*a*, 123*a* and 124*a* for engaging with the upper cover engaging small holes 120, 121, 122, 123 and 124 of the case 101 are formed in the bottom surface of the upper cover case 140. Press protruding members 125*a*, 130*a* and 130*b* are also arranged on the bottom surface of the upper cover 140. The press protruding member 125*a* urges the felt surface of the elastic plate 125 against the guide member 108 through the unused ribbon 103. The press protruding members 130*a* and 130*b* press the felt surface of the elastic plate 130 against the guide member 112 through the used ribbon 114. A projection 134*a* limits the height of a window for detecting a ribbon end. The projection 134*a* is formed to have a suitable height corresponding to that of the window 134. A circular opening 141 together with a circular opening formed in the bottom surface of the case 101 rotatably holds the core 115. An opening 142 is for confirming the remaining amount of the ribbon.

For example, a ribbon cassette having a construction as described above is mounted on a printing head carriage (not shown) of a printing apparatus. When the ribbon cassette is mounted, the cassette case is placed such that the holes 117 and 118 of the cassette case 101 receive locking pins 117*a* and 118*a* for positioning the cassette. A press locking member 135*a* for positioning the cassette and formed on the carriage engages a cassette positioning locking projection 135 of the case 101 and urges it in a horizontal direction. A ribbon end detector 119*a* arranged on the carriage 13 is then located inside the case 101 through the opening 119 thereof. The ribbon end detector 119*a* consists of a light-emitting element and a light-receiving element. Light emitted by the light-emitting element is irradiated onto the traveling unused ribbon 103 through the window 134. The light reflected by the ribbon 103 is received by the light-receiving element. Thus, an end mark attached to the end of the ribbon and having a reflectivity different from that of the ink ribbon is detected. When the ribbon cassette is mounted, a ribbon take-up spindle 115*a* on the carriage is engaged with the ribbon take-up core 115.

Figure 14A:
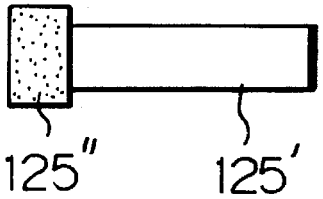
FIGS. 14A and 14B are front views of elastic plates with felt.
Figure 14B:
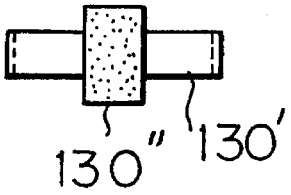
Figure 15A:
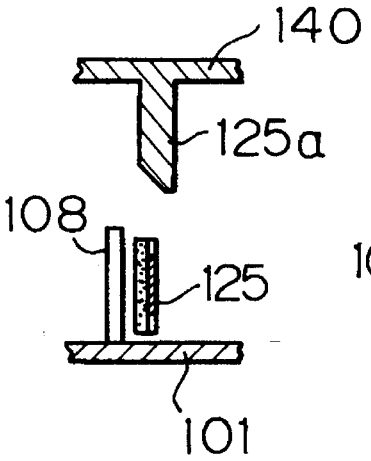
FIGS. 15A, 15B and 15C are side sectional views of portions near the elastic plates with felt when the upper cover is fitted on a cassette case.
Figure 15B:
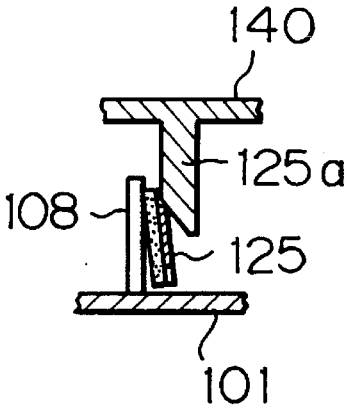
Figure 15C:
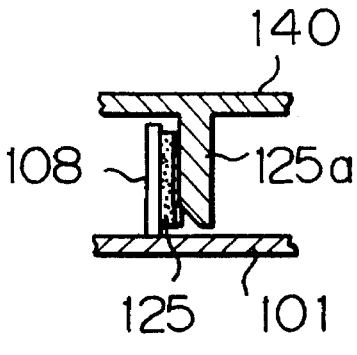
Figure 16:
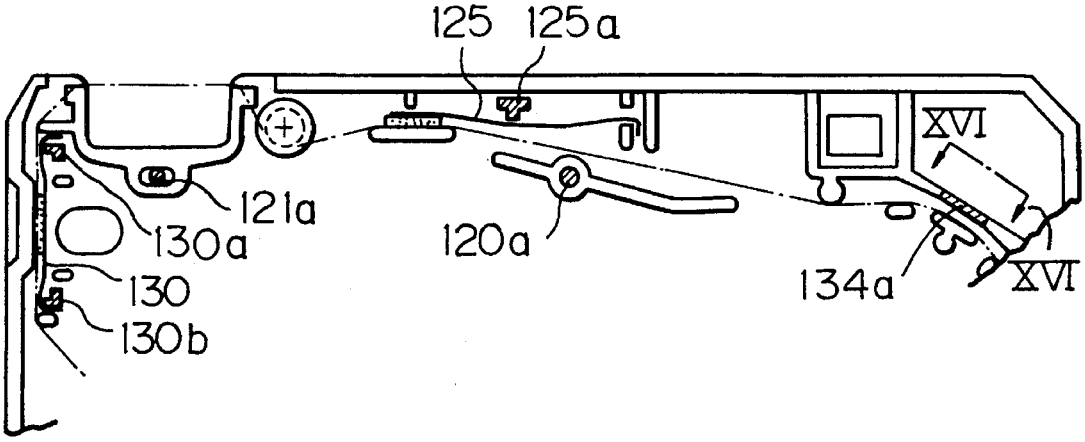
FIG. 16 is a plan view when the upper cover completely closes the cassette case.

In the ribbon cassette described above, the upper cover 140 is engaged with the case 101 by inserting the small projections 120*a*, 121*a*, 122*a*, 123*a* and 124*a* of the upper cover 140 in the small holes 120, 121, 122, 123 and 124 of the case 101. As shown in FIG. 12, before the upper cover 140 is engaged with the case 101, the elastic plate 125 is regulated in its position by the guide member 108 and position limiting members 126, 127, 128 and 129 through the unused ribbon 103 inside the case 101. Similarly, before the upper cover 140 is engaged with the case 101, as shown in FIG. 12, the elastic plate 130 is regulated in position by the guide member 112 and the guide members 111 and 113 through the used ribbon 114 inside the case 101. As shown in the front views in FIGS. 14A and 14B, each of the elastic plates 125 and 130 consists of a thin elastic plate 125' or 130' and a felt pad 125" or 130" of a predetermined thickness for causing friction. The distal end of the press protruding member 125*a* for the elastic plate 125 has an inclined surface. When the upper cover 140 is engaged with the case 101, the plate 125' is deflected by the protruding member 125*a* in the order of FIGS. 15A, 15B and 15C showing side views. The felt pad 125" is then urged against the guide member 108 through the unused ribbon 103. The elastic plate 130 and the protruding members 130*a* and 130*b* also operate in a similar manner. When the upper cover 140 is engaged with the cassette case 101, the felt pad 130" is urged against the guide member 112 through the used ribbon 114. FIG. 16 is a partial plan view showing when the upper cover 140 is completely engaged with the case 101. In FIG. 16, the flat portion of the upper cover 140 is omitted.

Figure 17:
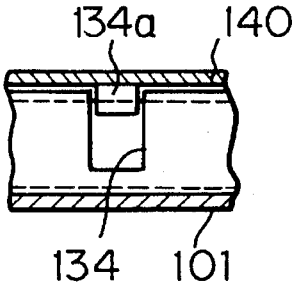
FIG. 17 is a perspective view along the line XVI—XVI in FIG. 16.

FIG. 17 is a perspective view along the line XVI—XVI in FIG. 16. A projection 134*a* is located above the ribbon end detection window 134 of the case 101 and limits its height, such that the effective opening of the window 134 corresponds to a portion of the ribbon 103 excluding its sides.

Figure 18:
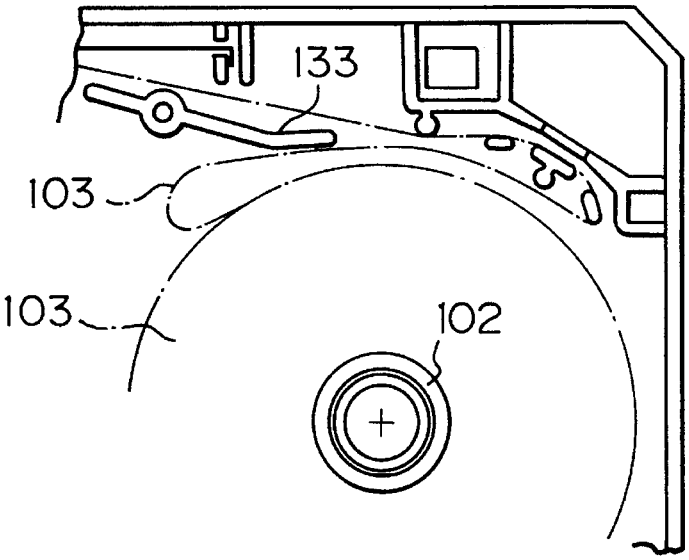
FIG. 18 is a partial plan view of a supply reel side when a slackening of an ink ribbon is caused.

In the ribbon cassette of this embodiment, the elastic plate 125 urges the unused ribbon 103 against the guide member 108 (FIG. 12) at a position ahead of the printing position 110 along the ribbon feed path. Therefore, a slackening of the unused ribbon 103 caused at a side of the supply reel 3 (FIG. 3) will not reach the printing position 110. Furthermore, since the elastic plate 130 urges the used ribbon 114 against the guide member 112 after the printing position 110, a slackening of the used ribbon 114 generated at the side of the take-up reel 4 will not reach the printing position 110. In the ribbon cassette of the embodiment described above, the unused ribbon 103 is sequentially bent in the same feeding direction by the guide member 104 at the right, the guide member 105 at the center, and the guide member 106 at the left, in the vicinity of the ribbon end detecting portion. Therefore, a slackening of the ribbon will rarely occur at this portion, the unused ribbon 103 will not be separated from the central guide member 105, and an erroneous detection will not occur. Furthermore, since the surface of the central guide member 105 which is brought into contact with the ribbon is flat, light emitted from the light-emitting element of the ribbon end detector 119*a* is reflected by the unused ribbon 103 and becomes incident on the light-receiving element of the detector 119*a* without loss in the light amount. In the ribbon cassette of this embodiment, even if a slackening of the unused ribbon 103 is caused near the ribbon end detecting portion, the height of the effective opening of the detection window 134 is smaller than the width of the ribbon 103 illustrated in FIG. 17, and the ribbon 103 is prevented from extending outside the case toward the ribbon end detector 119*a* through the window 134. In this ribbon cassette, the partition member 133 is arranged between the ribbon feed path and the supply reel. Therefore, even if the supply reel rotates by inertia upon stopping of the ribbon feed, the slackened portion of the unused ribbon 103 will not come to the feed path and entanglement or damage to the ribbon can be prevented, as shown in FIG. 18. The guide roller 109 and the guide member 111 (FIG. 12) are arranged immediately in front of and behind the printing position 110 along the ribbon feed path so as to bend the feed path abruptly, so that vertical oscillation of the ribbon at the printing position can be prevented. In this embodiment, the antistatic sheet 136 (e.g., "Looron") is used to prevent generation of static electricity by friction of the ribbon. For this reason, attraction of the travelling ribbon to the case by static electricity and any resultant slackening or entanglement of the ribbon can be prevented.

Figure 19:
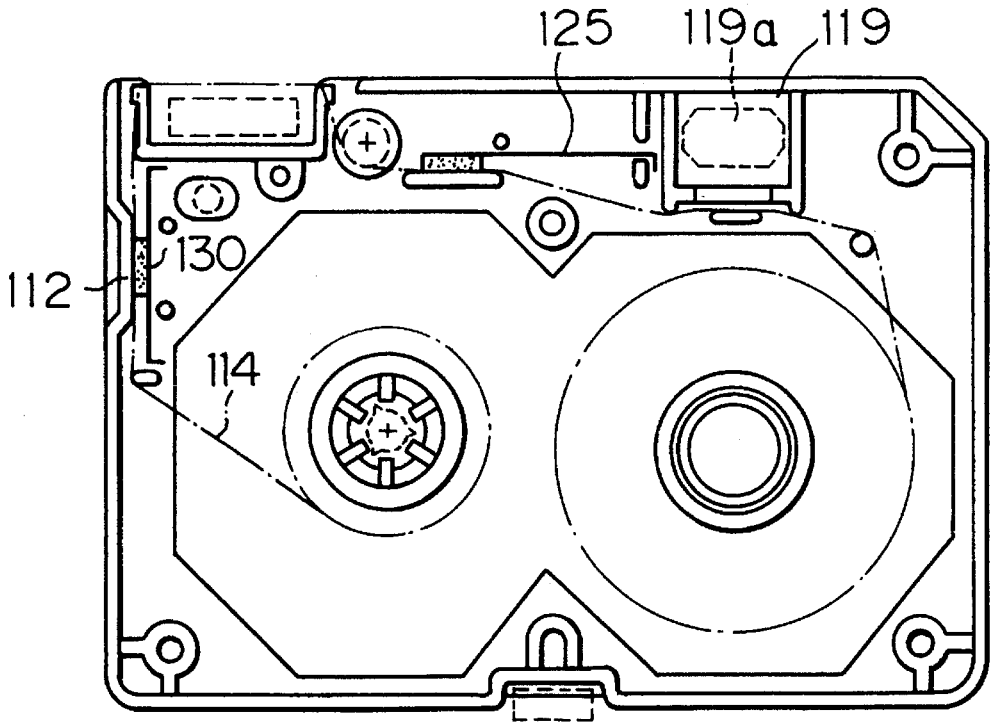
FIGS. 19 and 20 are plan views of ribbon cassettes according to fourth and fifth embodiments of the present invention, with upper covers being removed.

FIG. 19 is a plan view wherein an upper cover is removed from a cassette case of a ribbon cassette according to a fourth embodiment of the present invention. FIG. 19 corresponds to FIG. 12 showing the third embodiment. In the fourth embodiment, the hole 117 in FIG. 12 is omitted, and the opening 119 for receiving the ribbon end detector also serves as a positioning hole. Therefore, the ribbon end detector 119*a* also serves as the cassette positioning locking pin 117*a* in FIG. 12. Furthermore, although there is a slight difference in the ribbon feed path in the third and fourth embodiments, the same reference numerals denote the same parts which have similar effects in the third and fourth embodiments.

Figure 20:
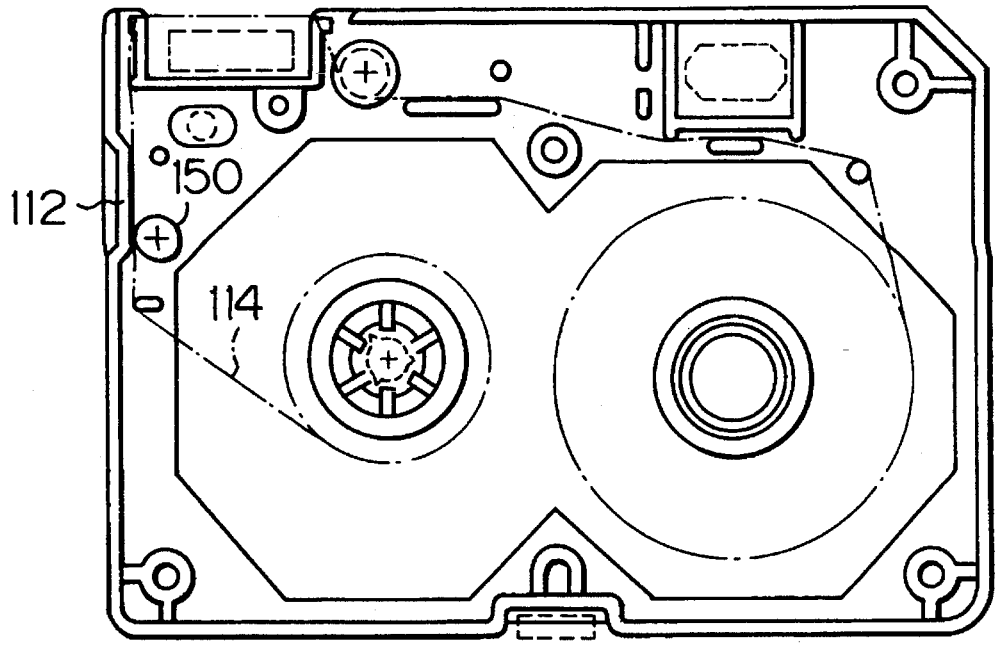

FIG. 20 shows a cassette case of a ribbon cassette according to a fifth embodiment of the present invention, wherein an upper cover is removed. FIG. 20 corresponds to FIG. 19 of the fourth embodiment. However, in the fifth embodiment, the elastic plates 125 and 130 in FIG. 19 are omitted, and a roller 150 for pressing the used ribbon 114 against the guide member 112 is arranged. In the fifth embodiment, a slackened portion of the ribbon generated at the side of the take-up reel will not reach the printing position. Other parts designated by the same reference numerals have similar effects to those in the fourth embodiment.

The present invention is not limited to the embodiments described above. For example, the printing head can be arranged at the right side instead of the left side, and the ribbon end detector can be arranged at the left side instead of the right side. The detector can be any type of a detector which can detect an end of a ribbon. The detector can also detect jamming of a ribbon. Thus, the detector need only detect a certain property of a ribbon and obtain corresponding information.

Holes for receiving a ribbon cassette positioning member or a ribbon end detector can be notches with escaping portions. The ribbon cassette can also be supported at three or more points.

What we claim is:

1. A cassette member in combination with a mounting mechanism provided in a recording apparatus, comprising:

a mounting mechanism having a mounting surface for detachably receiving a cassette member, said mounting mechanism including an elastic engaging member and first and second positioning members projecting from said mounting surface;

a cassette member having a box-like shape in which a bottom surface and an upper surface are connected with a side wall, said side wall including a first side wall which is opposed to a recording medium of the recording apparatus in a state that said cassette member is mounted on the recording apparatus, and a second side wall opposed to said first side wall;

an engaging section formed at substantially a center of an outer surface of said second side wall for engaging with said elastic engaging member of said mounting mechanism, with said engaging section having a projection with a first inclined surface being substantially flat along its entire length and a second inclined surface inclined with respect to a plane parallel to said bottom surface of said cassette member, said first inclined surface receiving a force having a first force component for stabilizing said cassette member in a direction transverse to the mounting surface and a second force component stabilizing said cassette member in a direction parallel to the mounting surface;

a first fitting section fittable with said first positioning member of said mounting mechanism projecting from said mounting surface proximate to a first end of said first side wall, said first positioning member having a member with a sloped portion sloping upward and going away from said first side wall, said first fitting section converting part of a biasing force by said elastic engaging member toward said first side wall to a pressing force for pressing said bottom surface proximate to said first side wall against said mounting surface, said first fitting section having an edge portion for limiting movement of said cassette member to the recording medium when said fitting section engages with the sloped portion of said first positioning member; and a second fitting section for limiting movement of said cassette member in a direction transverse to said first and second side walls and positioning said cassette member in a plane parallel to said bottom surface and transverse to the first force component by said elastic engaging member toward the recording medium in cooperation with said first fitting section when said second fitting section engages with said second positioning member of said mounting mechanism which projects from said mounting surface proximate to a second end of said first side wall, wherein when said cassette is mounted on said mounting surface of said mounting mechanism, said elastic engaging member applies a first positioning force that is utilized as a positioning force for pressing said bottom surface to said mounting surface and a second positioning force for positioning said cassette member in a plane parallel to said bottom surface.

2. A cassette member in combination with a mounting mechanism provided in a recording apparatus according to claim 1, wherein said first side wall includes a recess section, said cassette member further comprising an upstream ribbon pinching means, provided upstream of said recess section with respect to a forward winding direction of an ink ribbon, for pinching the ink ribbon as it extends substantially parallel to a reciprocal moving direction of said cassette member.

3. A cassette member in combination with a mounting mechanism provided in a recording apparatus according to claim 2, further comprising a downstream ribbon pinching means, provided downstream of said recess section with respect to the forward winding direction of the ink ribbon, for pinching the ink ribbon against a side wall of said cassette member proximate to said recess section.

4. A cassette member in combination with a mounting mechanism provided in a recording apparatus according to claim 3, wherein said upstream ribbon pinching means and said downstream ribbon pinching means each has an elastic plate covered with felt.

5. A recording apparatus in combination with a cassette member having an ink ribbon mountable on the recording apparatus, comprising:

a mounting mechanism having a mounting surface for detachably receiving a cassette member, said mounting mechanism including an elastic engaging member and first and second positioning members projecting from said mounting surface;

recording means cooperating with the ink ribbon for recording on a recording medium; and a cassette member having a box-like shape in which a bottom surface and an upper surface are connected with a side wall, said side wall including a first side wall which is opposed to the recording medium of the recording apparatus in a state that said cassette member is mounted on the recording apparatus, and a second side wall opposed to said first side wall;

an engaging section formed at substantially a center of an outer surface of said second side wall for engaging with said elastic engaging member of said mounting mechanism, with said engaging section having a projection with a first inclined surface being substantially flat along its entire length and a second inclined surface inclined with respect to a plane parallel to said bottom surface of said cassette member, said first inclined surface receiving a force having a first force component for stabilizing said cassette member in a direction transverse to the mounting surface and a second force component stabilizing said cassette member in a direction parallel to the mounting surface;

a first fitting section fittable with said first positioning member of said mounting mechanism projecting from said mounting surface proximate to a first end of said first side wall, said first positioning member having a member with a sloped portion sloping upward and going away from said first side wall, said first fitting section converting part of a biasing force by said elastic engaging member toward said first side wall to a pressing force for pressing said bottom surface proximate to said first side wall against said mounting surface, said first fitting section having an edge portion for limiting movement of said cassette member to the recording medium when said fitting section engages with the sloped portion of said first positioning member; and a second fitting section for limiting movement of said cassette member in a direction transverse to said first and second side walls and positioning said cassette member in a plane parallel to said bottom surface and transverse to the first force component by said elastic engaging member toward the recording medium in cooperation with said first fitting section when said second fitting section engages with said second positioning member of said mounting mechanism which projects from said mounting surface proximate to a second end of said first side wall, wherein when said cassette member is mounted on said mounting surface of said mounting mechanism, said elastic engaging member applies a force that is utilized as a first positioning force for pressing said bottom surface to said mounting surface and a second positioning force for positioning said cassette member in a plane parallel to said bottom surface.

6. A recording apparatus in combination with a cassette member according to claim 5, wherein said first side wall includes a recess section, said cassette member further comprising an upstream ribbon pinching means, provided upstream of said recess section with respect to a forward winding direction of the ink ribbon, for pinching the ink ribbon as it extends substantially parallel to a reciprocal moving direction of said cassette member.

7. A recording apparatus in combination with a cassette member according to claim 6, further comprising a downstream ribbon pinching means, provided downstream of said recess section with respect to the forward winding direction of the ink ribbon, for pinching the ink ribbon against a side wall of said cassette member proximate to said recess section.

8. A recording apparatus in combination with a cassette member according to claim 7, wherein said upstream ribbon pinching means and said downstream ribbon pinching means each has an elastic plate covered with felt.

9. A cassette member in combination with a mounting mechanism provided in a recording apparatus, said mounting mechanism having a mounting surface for detachably receiving said cassette member, an elastic engaging member, and first and second projecting members projecting from said mounting surface, said cassette member being removably mountable on said mounting surface, said cassette member comprising:

a cassette case having a box-like shape in which a bottom surface and an upper surface are connected with a side wall, said side wall including a first side wall which is opposed to a recording medium of the recording apparatus in a state that said cassette member is mounted on the recording apparatus, and a second side wall opposed to said first side wall;

an engaging section formed at substantially a center of an outer surface of said second side wall for engaging with said elastic engaging member of said mounting mechanism, with said engaging section having a projection with a first inclined surface being substantially flat along its entire length and a second inclined surface inclined with respect to a plane parallel to said bottom surface of said cassette case, said first inclined surface receiving a force having a first force component for stabilizing said cassette member in a direction transverse to the mounting surface and a second force component stabilizing said cassette member in a direction parallel to the mounting surface;

a first fitting section fittable with said first positioning member of said mounting mechanism projecting from said mounting surface proximate to a first end of said first side wall, said first positioning member having a member with a sloped portion sloping upward and going away from said first side wall, said first fitting section converting part of a biasing force by said elastic engaging member toward said first side wall to a pressing force for pressing said bottom surface proximate to said first side wall against said mounting surface, said first fitting section having an edge portion for limiting movement of said cassette member to the recording medium when said fitting section engages with the sloped portion of said first positioning member; and a second fitting section for limiting movement of said cassette member in a direction transverse to said first and second side walls and positioning said cassette member in a plane parallel to said bottom surface and transverse to the first force component by said elastic engaging member toward the recording medium in cooperation with said first fitting section when said second fitting section engages with said second positioning member of said mounting mechanism which projects from said mounting surface proximate to a second end of said first side wall, wherein when said cassette is mounted on said mounting surface of said mounting mechanism, said elastic engaging member applies a first positioning force that is utilized as a positioning force for pressing said bottom surface to said mounting surface and a second positioning force for positioning said cassette member in a plane parallel to said bottom surface.

10. A cassette member in combination with a mounting mechanism provided in a recording apparatus according to claim 9, wherein said first side wall includes a recess section and further comprising an upstream ribbon pinching means, provided upstream of said recess section with respect to a forward winding direction of the ink ribbon, for pinching the ink ribbon as it extends substantially parallel to a reciprocal moving direction of said cassette member.

11. A cassette member in combination with a mounting mechanism provided in a recording apparatus according to claim 10, further comprising a downstream ribbon pinching means, provided downstream of said recess section with respect to the forward winding direction of the ink ribbon, for pinching the ink ribbon against a side wall of said cassette member proximate to said recess section.

12. A cassette member in combination with a mounting mechanism provided in a recording apparatus according to claim 11, wherein said upstream ribbon pinching means and said downstream ribbon pinching means each has an elastic plate covered with felt.

* * * * *

UNITED STATES PATENT AND TRADEMARK OFFICE

CERTIFICATE OF CORRECTION

PATENT NO. 5,593,237

DATED January 14, 1997

INVENTOR(S) Nozaki et al.

It is certified that error appears in the above-indentified patent and that said Letters Patent is hereby corrected as shown below:

COLUMN 5:

Line 10, "projecttions" should read --projections--.

COLUMN 8:

Line 50, "entanglement" should read --entanglement of--.

Signed and Sealed this

Seventeenth Day of June, 1997

Bruce Lehman

*Attest:*

BRUCE LEHMAN

*Attesting Officer*

*Commissioner of Patents and Trademarks*